United States Patent [19]

Dean et al.

[11] Patent Number: 4,489,881

[45] Date of Patent: Dec. 25, 1984

[54] AIR DELIVERY SYSTEM FOR HOSPITAL ROOMS AND THE LIKE

[75] Inventors: Raymond H. Dean, Shawnee Mission; Michael M. Roberts, Leawood, both of Kans.

[73] Assignee: Tempmaster Corporation, Kansas City, Mo.

[21] Appl. No.: 575,458

[22] Filed: Jan. 30, 1984

[51] Int. Cl.[3] ..... F24F 7/00

[52] U.S. Cl. ..... 236/49; 98/1.5; 98/33.1

[58] Field of Search ..... 165/16; 98/1.5; 236/49; 98/33 R

[56] References Cited

U.S. PATENT DOCUMENTS 3,830,145 8/1974 Holt et al. ..... 98/33

4,175,401 11/1979 McManus ..... 236/49 X 4,407,185 10/1983 Haines et al. ..... 98/1.5

*Primary Examiner*—William E. Wayner

*Attorney, Agent, or Firm*—Kokjer, Kircher, Bradley, Wharton, Bowman & Johnson

[57] ABSTRACT

A method and apparatus for delivering conditioned air to hospital patient rooms or clean rooms which are maintained at a higher or lower pressure level than the adjacent halls. A constant volume delivery duct is provided to counter the constant volume toilet exhaust, and the flow rates in the constant volume ducts are selected to maintain the desired pressure level in the room. The room temperature is maintained by a variable volume system including a variable volume supply duct and a variable volume return duct. Dampers in the variable volume ducts are controlled in unison to control the room temperature as desired while always maintaining equal inflow and outflow in the variable volume system to maintain the pressure level in the room. A specially constructed and partitioned terminal unit provides a terminal for the variable volume supply and return ducts and the constant volume supply duct.

18 Claims, 3 Drawing Figures

CONSTANT - VOLUME VARIABLE - TEMPERATURE SUPPLY, FOR SKIN LOAD
VARIABLE - VOLUME RETURN
CONSTANT TEMPERATURE (USUALLY COLD) VARIABLE - VOLUME SUPPLY FOR LIGHTS & PEOPLE
LOW VELOCITY DUCT (SUPPLY)
RETURN AIR (VAV)
PATIENT ROOM
SUPPLY AIR (VAV)
CONSTANT VOLUME SUPPLY AIR
TOILET EXHAUST

AIR DELIVERY SYSTEM FOR HOSPITAL ROOMS AND THE LIKE

BACKGROUND OF THE INVENTION

This invention relates generally to the distribution of conditioned air and deals more specifically with an air distribution system which is specially arranged to deliver conditioned air to hospital patient rooms, research laboratories, or industrial clean rooms.

The heating and cooling of most large buildings is achieved by heating or cooling air and passing the conditioned air through ventilating ducts that extend throughout the building. Individual temperature control of each separate room is desirable and is usually accomplished by equipping each duct or each terminal unit with a flow control device such as a damper. Each flow control device can be individually controlled to adjust the volume of conditioned air that flows into the room, thus providing individual control of the room temperature. This type of air distribution system is generally high in efficiency and low in cost because a large number of rooms can be supplied by a single large heating or cooling unit.

The delivery of conditioned air to hospital patient rooms and other "clean" rooms has presented special problems, primarily because patient rooms must be maintained at pressures different from the ambient pressure in adjacent spaces. By maintaining the hospital patient room (or clean room) pressure at a relatively higher level, bacteria and other contaminants are prevented from migrating into the room; conversely, by maintaining the patient room (or clean room) pressure at a relatively lower level, bacteria and other contaminants are prevented from migrating from the room. The need to maintain pressure difference between patient rooms and surrounding spaces has prevented the use of variable air volume systems in the past because such systems normally exhaust as much air as is delivered to the room at design conditions, and a pressure differential cannot be maintained when the variable air volume supply air quantity is reduced. Consequently, hospitals (and other clean room type facilities) have not taken advantage of the recognized operating efficiencies and other benefits of variable air volume air distribution systems. The air delivery systems that are currently used in these applications are only 50–70% as efficient as variable volume systems, and the resulting high energy costs have contributed significantly to the rapid escalation of hospital operating costs.

SUMMARY OF THE INVENTION

The present invention is directed to an improved system for efficiently delivering conditioned air to hospital patient rooms, laboratories, industrial "clean" rooms and in other specialized applications involving the maintenance of prescribed pressure differentials between the conditioned area and the surrounding space. In accordance with the invention, a supply of conditioned air is delivered to the clean room at a constant volume rate, and a constant volume exhaust system exhausts air from the room at a rate less than or greater than the inflow as required to maintain the desired pressure relationship. For example, if a hospital room is to be maintained at a higher pressure level than the hall to prevent inflow of contaminants, the exhaust rate is less than the inflow rate. Variable volume supply and return ducts have flow control devices such as dampers that are open and closed in unison to effect corresponding changes in the inflow and outflow rates for increased or reduced heating or cooling. By using this arrangement and supplying more air to the supply duct than is exhausted through the return duct, a relatively high pressure level is maintained in the patient room to prevent the transport of bacteria and other contaminants into the room by air migration. Conversely, by using this arrangement and supplying less air to the supply duct than is exhausted through the return duct, a relatively low pressure level is maintained to prevent the transport of bacteria and other contaminants out of the room. The delivery of conditioned air to the room at variable air volume is a significant feature of the invention because it makes the economic advantages of vairable volume systems available to hospitals in order to achieve a reduction in overall energy use and the hospital operating cost.

Typically, hospital patient rooms have a constant volume toilet exhaust which is countered in the present invention by a separate supply of air which is delivered to the room at a constant volume. The constant volume air supply can be heated or cooled if desired, depending upon the control scheme that is best suited for the combination of outside weather factors and internally generated loads. The constant volume supply duct can be entirely separate from the variable volume system, or it can be partially combined with the variable volume system. If the constant volume supply duct is separate, the variable volume supply and return ducts can be equipped with side by side dampers mounted on a common shaft. The shaft can be rotated by a suitable operator which is controlled by a conventional thermostat located in the patient room.

If it is desired to partially combine the constant volume system with the variable volume system, various arrangements can be used. In one embodiment of the invention, a special terminal unit is partitioned into three separate chambers which connect with the variable volume supply duct, the variable volume return duct, and the constant volume supply duct. The terminal unit has a diffuser slot through which the incoming conditioned air is discharged into the room and the outgoing return air is passed for delivery to the variable volume return air duct. Dampers for the variable volume supply and return ducts are mounted in the terminal unit and connected by a linkage which assures that they open and close in unison. The dampers are controlled by a suitable operator such as a power cylinder actuated by the room thermostat.

It is an object of the invention to provide a method and apparatus for delivering conditioned air to hospital patient rooms and other clean rooms more efficiently than the systems that are currently used in such applications.

Another object of the invention is to provide a variable volume air delivery system which is specially arranged for use in rooms that are maintained at a relatively high (or relatively low) pressure level.

A further object of the invention is to provide, in an air delivery system of the character described, an arrangement for controlling the variable volume supply and return ducts in a manner to assure that the inflow of conditioned air is greater than (or less than, if required) the outflow of return air.

An additional object of the invention is to provide an air delivery system of the character described in which the constant volume toilet exhaust from a hospital patient room is countered by a constant volume supply of conditioned air having a temperature that can be varied in accordance with the heating or cooling load requirements.

Yet another object of the invention is to provide, in an air delivery system of the character described, a terminal unit which is specially constructed to accommodate the variable volume supply and return ducts and the constant volume supply duct.

A still further object of the invention is to provide an air delivery system of the character described which is simple and economical to construct and install and which operates in an efficient and reliable manner.

Other and further objects of the invention, together with the features of novelty appurtenant thereto, will appear in the course of the following description.

DETAILED DESCRIPTION OF THE INVENTION

In the accompanying drawing which forms a part of the specification and is to be read in conjunction therewith and in which like reference numerals are used to indicate like parts in the various views.

Figures 1, 2, 3:
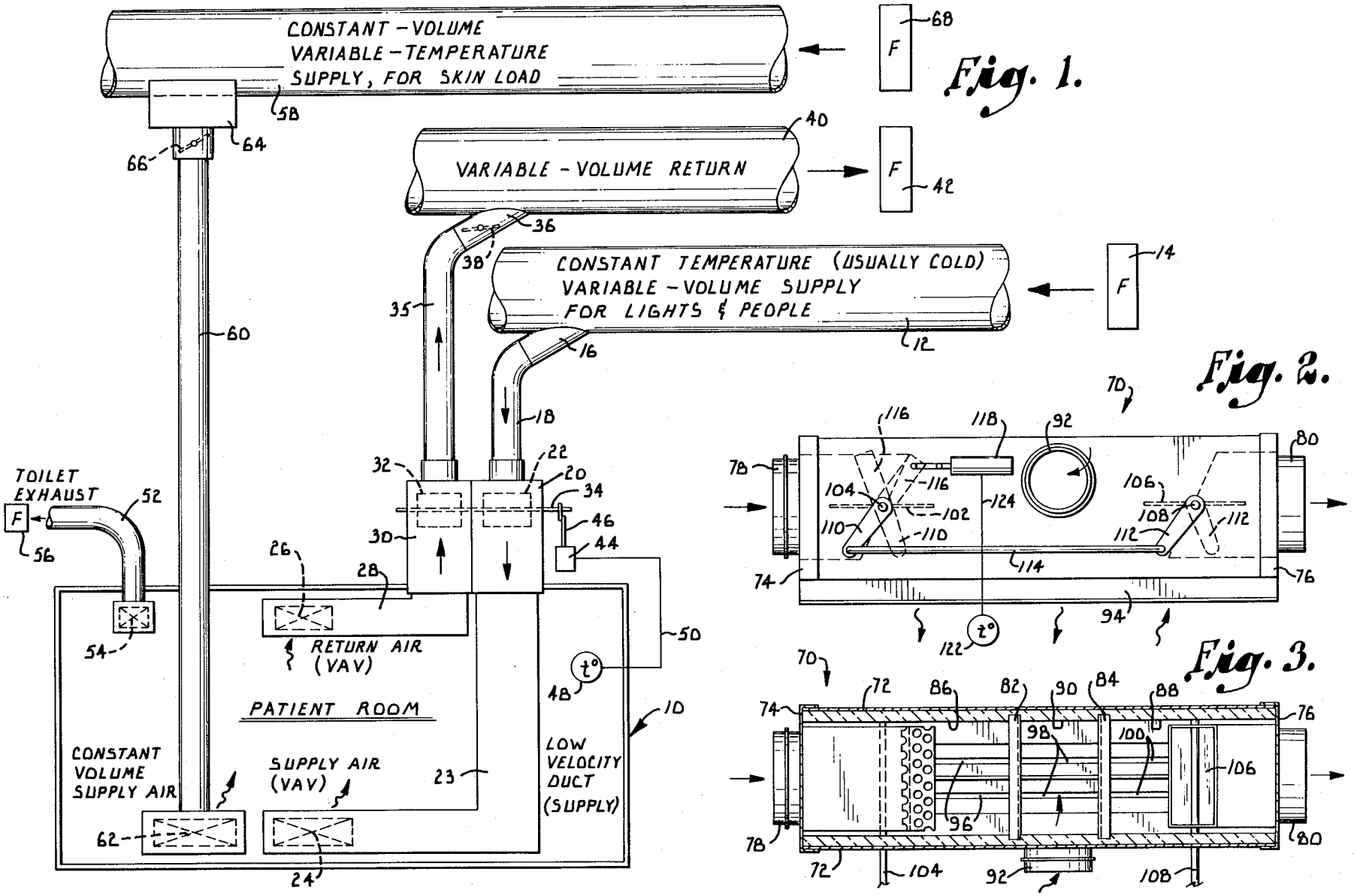
FIG. 1 is a diagrammatical view of an air delivery system for hospital patient rooms constructed according to a preferred embodiment of the present invention.
FIG. 2 is a side elevational view of a special terminal unit which can be incorporated in the air delivery system of the present invention.
FIG. 3 is a top plan view of the terminal unit shown in FIG. 2, with the top panel removed for illustrative purposes.

Referring now to the drawing in more detail and initially to FIG. 1, numeral 10 generally designates a hospital patient room to which conditioned air is delivered by the air distribution system of the present invention. In order to prevent germs and other contaminants from being transported into the patient room 10 by air migration, it is common practice for the pressure level in the patient room to be maintained at a slightly higher level than the pressure level in the hallway and other surrounding areas of the hospital building. Similarly, in order to prevent germs and other contaminants from being transported out of the room 10 by air migration, it is common practice for the pressure level in the room to be maintained at a slightly lower level than the pressure level in the surrounding spaces.

In accordance with the present invention, a variable volume supply duct 12 is supplied with conditioned air which is heated or cooled by a central heating or cooling unit (not shown) and forced through the supply duct 12 by a conventional fan 14. The conditioned air that is forced through the variable volume supply duct 12 has a constant temperature which can be reset as desired. Downstream from the fan 14, a fitting 16 connects the supply duct 12 with a branch duct 18 which leads to a box-like housing 20 containing a control damper 22. The downstream end of housing 20 connects with a duct 23 that extends within the patient room 10 and terminates in an air diffuser 24 having an outlet for discharging the conditioned supply air into the room. The main supply duct 12 similarly supplies conditioned air to other patient rooms of the hospital.

The present invention also provides a variable volume exhaust system for exhausting return air from the room at a variable volume rate. A return register 26 in the patient room 10 provides an inlet for a return duct 28 that extends within the room. Duct 28 connects with a box like damper housing 30 containing a control damper 32. The two damper housings 20 and 30 are located side by side, and the two dampers 22 and 32 are mounted on a common shaft 34 which is suitably supported for turning movement to open and close the two dampers in unison. The downstream end of housing 30 connects with a duct 35 which leads to a fitting 36 that may contain an adjustable balancing damper 38. The fitting 36 connects with a variable volume return duct through which air is drawn by a fan 42. The balancing damper 38 is mounted at the intersection of the ducts 35 and 40 so that when closed it forms an approximate extension of the side wall of duct 40, and so that when slightly open it directs the air from duct 35 into duct 40 in the direction of the return fan 42. This damper arrangement enables air from duct 35 to give an induction or jet-pump boost to the air traveling down duct 40 and thereby help maintain a nearly uniform negative pressure along the return duct 40, with varying system flow rates. This uniform pressure helps to assure the proper relation between supply and return flow through unit 30 in each hospital room, regardless of load variations in the building.

The position of the rotatable shaft 34 is controlled by a suitable operator 44 which may be a pneumatic or electric motor connected with the shaft by a suitable linkage 46. A conventional room thermostat 48 located in the patient room 10 is connected with the operator 44 by a control line 50. The thermostat 48 controls the operator 44 which in turn controls the position of shaft 34 to adjust the dampers 22 and 32 in unison. Each damper has a fully closed position wherein flow past the damper is prevented. Likewise, each damper has a fully opened position in which the flow past the damper is substantially unimpeded. Mounting of the dampers on the same shaft 34 assures that each damper is always in the same position as the other damper. Thus, when either damper is fully closed, the other damper is fully closed and when either damper is fully open or partially open, the other damper is fully open or at the same partially open position.

The patient room 10 has a toilet exhaust system including an exhaust duct 52 having a register 54 located in the room. A fan 56 exhaust air through duct 52 at a constant volume rate.

In order to counter the constant toilet exhaust, the present invention provides a constant volume duct 58 which supplies a constant volume rate of conditioned air to a branch duct 60 leading to a terminal unit 62 located in the patient room 10. The terminal unit 62 may be an air diffuser. A T-fitting 64 containing a balancing damper 66 provides a connection between the main duct 58 and the branch duct 60. The main duct 58 supplies additional branch ducts leading to other patient rooms of the hospital. The volume rate at which air is directed into the room through terminal unit 62 is constant and may be less than, greater than or equal to the volume rate at which air is exhausted from the room through the toilet exhaust duct 52, depending upon the pressure requirements. A fan 68 forces air through the constant volume supply duct 58. The constant volume air supply that is passed through duct 58 can be heated or cooled, depending upon the outdoor weather conditions and the loads that are generated internally of the hospital.

In operation of the air delivery system shown in FIG. 1, heated or cooled air is passed through the variable volume supply duct 12 by fan 14 and flows past damper 22 and into the patient room 10 through duct 23 and the diffuser unit 24. Return air is drawn by fan 42 into the return register 26 and flows through duct 28 and past damper 32 into branch duct 35 and through induction damper 38 into the variable volume return duct 40. The amount of air supplied by fan 14 for delivery into room 10 is equal to the amount of return air that is drawn out of the room by the exhaust fan 42, since the two control dampers 22 and 32 are maintained at the same position at all times. Thus, the inflow of conditioned air into room 10 through the variable volume system is always matched by the outflow of air in the variable system. To maintain a pressure level within room 10 that is greater than the pressure level in the adjacent hall way, the constant volume air supply entering the room through duct 60 is designed to be greater than the constant volume exhausting through the toilet exhaust duct 52. As a consequence, migration of germs and other bacteria into the patient room 10 is prevented.

If the room is to be maintained at a relatively low pressure compared to surrounding spaces, the amount of air supplied into room 10 through duct 60 is slightly less than the amount of return air that is drawn out of the room by the toilet exhaust fan 56. Since the two control dampers 22 and 32 are maintained at the same position at all times, the inflow of conditioned air into room 10 is always less than the outflow of air, thus maintaining a pressure level within room 10 that is lower than the pressure level in the adjacent hallways. As a result, migration of germs and other bacteria out of room 10 is prevented.

The thermostat 48 controls the damper position in both the heating and cooling modes of operation. When the thermostat calls for more cooling air, the thermostat signals operator 44 via line 50, and the operator linkage 46 is activated to turn shaft 34 in a direction to open both dampers 22 and 32. The additional opening of damper 22 results in the inflow of more cooling air from the variable volume supply duct 12, and the additional inflow is offset by an increased outflow of air past damper 32. Since the relationship between the amount of air supplied by duct 60 and the amount exhausted by duct 52 does not change, the pressure in the room relative to the surrounding area does not change. At the same time, the thermostat control of the supply damper 22 assures that the temperature setting of the thermostat is achieved.

In the heating mode of operation, heated air is passed through the variable volume supply duct 12, and damper 22 is open and closed under the control of the thermostat 48. If there is no need for heating or cooling by the variable volume system, both dampers 22 and 32 are closed. When the thermostat senses an actual temperature within room 10 that is lower than the thermostat setting, additional heat is called for and damper 22 is opened more fully to supply more heated air. The return damper 32 is correspondingly opened so that relative pressure levels are maintained in the patient room at all times.

FIGS. 2 and 3 illustrate a special terminal unit 70 which can serve as a terminal for both the variable volume supply and return branch ducts 18 and 35 and the constant volume supply branch duct 60. The special terminal unit 70 has a rectilinear housing formed by opposite side panels 72, flanged end panels 74 and 76, and a top panel (not shown). An inlet 78 extends through end panel 74. The branch duct 18 (FIG. 1) connects with inlet 78 in order to direct incoming variable volume supply air into the terminal unit. An outlet 80 extends through the opposite end panel 76 and connects with the variable volume return branch duct 35 in order to direct the return air into the main return duct 40.

A pair of partitions 82 and 84 divide the interior of the terminal unit into three separate compartments or chambers. One chamber 86 is formed between partition 82 and end panel 74, and another chamber 88 is formed between the other partition 84 and the other end panel 76. A central chamber 90 is formed between the two partitions 82 and 84. Inlet 78 opens into chamber 86, while the outlet 80 opens into chamber 88. A second inlet 92 extends through one of the side panels 72 and opens into the central chamber 90. The constant volume supply branch duct 60 is connected with inlet 92 in order to direct the constant volume supply air into the terminal unit.

An air diffuser 94 is mounted on the bottom of the terminal unit 70. The air diffuser 94 presents elongated slots which the partitions 82 and 84 separate into two slots 96 disposed below and in communication with chamber 86, another pair of slots 98 disposed below and in communication with the central chamber 90, and a third pair of slots 100 disposed below and in communication with chamber 88. Slots 96 and 98 provide outlets into the patient room 10 for the variable volume supply air in chamber 86 and the constant volume supply air in chamber 90, respectively. Slots 100 open into the patient room 10 and provides inlets for the variable volume return air which is drawn from the room.

The inflow of air from inlet 78 to chamber 86 is controlled by a damper 102 which is mounted on a horizontal shaft 104 supported on the terminal unit for turning movement. The flow from chamber 88 into the outlet 80 is similarly controlled by a pivotal damper 106 mounted on a shaft 108 supported on the terminal unit and extending parallel to shaft 104. Parallel links 110 and 112 are connected with the respective shafts 104 and 108. The lower ends of links 110 and 112 are connected by a horizontal rod 114 which assures that the two links 110 and 112 move in unison to open and close dampers 102 and 106 in unison.

Link 110 has an upward extension 116 which is connected with the rod end of a power cylinder 118. The cylinder 118 is controlled by a thermostat 122 located within the hospital room 10. Control line 124 leads from the thermostat to the cylinder 118. The control arrangement causes the cylinder 118 to extend and retract its piston rod so that dampers 102 and 106 are opened and closed in unison. Retraction of the cylinder maintains the dampers in the fully open positions shown in FIG. 2, while extension of the cylinder pivots the dampers in unison to the fully closed positions wherein the inlet 78 and outlet 80 are both closed.

In operation, the terminal unit 70 serves as a terminal for the variable volume supply system, the variable volume return system, and the constant volume supply system. The constant volume supply is forced through duct 58 and branch duct 60 into chamber 90 through inlet 92. The supply air is directed into the patient room 10 through slots 98 at a constant volume rate and exhaust air is removed at a constant volume rate through the toilet exhaust duct 52. The incoming variable volume supply is forced through the main supply duct 12 and branch duct 18 into chamber 86 through inlet 78. The volume rate of flow into chamber 86 is controlled by the position of damper 102. The air in chamber 86 is directed into the room through the outlet slots 96.

The return air is drawn through slots 100 into chamber 88 and passes through outlet 80 at a rate controlled by the position of damper 106. From the outlet 80, the return air passes through the branch duct 35 and the main variable volume return duct 40.

The thermostat 122 senses the room temperature and activates cylinder 118 to effect opening or closing of dampers 102 and 106 in unison. If additional heating or cooling is called for by the thermostat, the dampers are more fully opened, and if the thermostat is satisfied, the dampers are closed. Again, relative pressure levels are maintained within the patient room 10 due to the opening and closing of dampers 102 and 106 in unison under the control of the thermostat 122. The chambers 86, 88 and 90 are isolated from one another so that the variable volume supply, variable volume return and constant volume supply systems do not interfere with one another.

In addition to hospitals, the system can be employed in any kind of facility having special room pressure requirements to preserve cleanliness. Also, we have referred primarily to cases where a positive pressure is desired to maintain a net exfiltration from the room in question. By simply re-adjusting the damper settings, the invention can be applied equally well to cases where a negative pressure is desired to maintain net infiltration into the room in question—to keep contaminants in that room from escaping to other parts of the facility.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawing is to be interpreted as illustrative and not in a limiting sense.

Having thus described the invention, what is claimed is :

1. A method of delivering conditioned air to a room which is to be maintained at a pressure level different from adjacent areas, said method comprising the steps of:

forcing air into the room at a constant inflow rate;

exhausting air from the room at a constant outflow rate having a relationship to the inflow rate to maintain the room at said different pressure level;

supplying conditioned air to the room at a variable inflow rate;

removing air from the room at a variable outflow rate; and varying the variable inflow and variable outflow rates to vary the amount of conditioned air supplied to the room in accordance with the demand therefor while constantly maintaining substantial equality between the variable inflow rate and the variable outflow rate.

2. A variable volume air delivery system for applying conditioned air to a room which is to be maintained at a preselected pressure level different from adjacent areas, said system comprising:

a constant volume air supply duct having an outlet in the room for delivering air thereto;

a constant volume exhaust duct having an inlet in the room for removing air therefrom;

means for forcing air through said constant volume supply duct and into the room at a constant inflow rate;

means for exhausting air from the room through said exhaust duct at a constant outflow rate related to said constant inflow rate in a manner to maintain the pressure in the room at said preselected pressure level;

a variable volume air supply duct for supplying conditioned air to the room;

a variable volume air return duct for removing air from the room;

means for forcing air through said variable volume supply and return ducts;

flow control means for varying the volume rate of inflow through said variable volume supply duct and outflow through said variable volume return duct; and means for adjusting said flow control means in a manner to vary said inflow and outflow rates to vary the amount of conditioned air supplied to the room while constantly maintaining substantial equality between said inflow and said outflow.

3. The invention of claim 2, including:

a terminal unit in the room providing outlets for the constant and variable volume supply ducts and an inlet for the return duct; and means for dividing said terminal unit into a first chamber communicating with said variable volume supply duct and the outlet therefor, a second chamber communicating with said return duct and the inlet therefor, and a third chamber communicating with said constant volume supply duct and the outlet therefor.

4. The invention of claim 3, wherein said flow control means comprises:

a supply damper mounted on said terminal unit for modulation between open and closed positions respectively permitting and preventing air flow from the variable volume supply duct into the first chamber; and a return damper mounted on said terminal unit for modulation between open and closed positions respectively permitting and preventing air flow from the second chamber into the return duct.

5. The invention of claim 4, wherein said adjusting means is operable to open and close said supply and return dampers in unison.

6. The invention of claim 5, including thermostat means in the room for controlling said adjusting means.

7. The invention of claim 2, including:

a terminal unit in the patient room providing an outlet for variable volume supply duct and an inlet for said return duct; and means for dividing said terminal unit into first and second chambers respectively communicating with the outlet for the variable volume supply duct and the inlet for the return duct, said variable volume supply duct connecting with said first chamber and said return duct connecting with said second chamber.

8. The invention of claim 7, wherein:

said terminal includes an air diffuser presenting an elongated slot; and said slot is divided into a first portion providing the outlet for said variable volume supply duct and a second portion providing the inlet for said return duct.

9. The invention of claim 7, wherein:

said first chamber is located adjacent one end of the terminal unit and said second chamber is located adjacent an opposite end of the terminal unit; and said variable volume supply duct connects with said one end of the terminal unit and said return duct connects with said opposite end of the terminal unit.

10. The invention of claim 2, wherein said flow control means includes:

a shaft extending into said variable volume supply and return ducts and supported for turning movement;

a supply damper mounted in the variable volume supply duct on said shaft for opening and closing movement upon turning of the shaft to open and close the variable volume supply duct; and a return damper mounted in the return duct on said shaft for opening and closing movement upon turning of the shaft to open and close the return duct, both dampers opening in response to turning of said shaft in one direction and closing in response to turning of the shaft in the opposite direction.

11. The invention of claim 10, wherein said adjusting means includes:

thermostat means in the room for sensing the temperature conditions therein; and thermostat responsive operator means for turning said shaft in opposite directions to open and close the supply and return dampers in unison when a discrepancy is present between the sensed temperature conditions and said preselected temperature conditions.

12. The invention of claim 2, including:

a main duct section of the return duct;

an intermediate duct section oriented to direct return air therefrom into the main duct section in a direct or generally parallel to the direction of air flow in the main duct section, thereby adding momentum to the air flowing in the main duct section.

13. A variable air delivery system for a room having a constant volume exhaust duct through which air is exhausted from the room at a substantially constant volume exhaust rate, said system comprising:

constant volume air delivery duct means leading to the patient room for delivering air thereto at a constant volume rate related to the constant volume exhaust rate in a manner to maintain the room at a preselected pressure level relative to adjacent areas;

a variable volume air supply duct having an outlet in the room for supplying conditioned air thereto at a variable volume rate;

fan means for forcing conditioned air through said supply duct into the room;

an adjustable flow control device in said supply duct for varying the volume rate of air flow therein;

a variable volume return duct having an inlet in the room for removing air therefrom at a variable volume rate;

an adjustable flow control device in said return duct for varying the volume rate of air flow therein; and means for adjusting said flow control devices in unison in a manner to effect an inflow rate of conditioned air through the supply duct substantially equal to the outflow rate through the return duct, thereby varying the temperature in the room while maintaining the room at said preselected pressure level.

14. The invention of claim 13, wherein:

said flow control devices comprise dampers mounted on a common rotatable shaft in the respective supply and return ducts for movement in unison between open and closed positions in response to rotation of the shaft; and said adjusting means includes thermostat means in the room for sensing the actual temperature conditions therein and for effecting rotation of the shaft when there is a discrepancy between said preselected temperature conditions and the actual temperature conditions sensed by said thermostat means.

15. The invention of claim 13, including:

a terminal unit in the room providing said outlet for the supply duct and said inlet for the return duct;

means for dividing said terminal unit in a manner to define therein first and second chambers respectively communicating with said outlet and said inlet; and means for connecting said supply duct with the first chamber and said return duct with the second chamber.

16. The invention of claim 15, wherein:

said flow control device in the supply duct comprises a first damper mounted in said first chamber for movement between open and closed positions respectively permitting and preventing flow from the supply duct to the first chamber;

said flow control device in the return duct comprises a second damper mounted in said second chamber for movement between open and closed positions respectively permitting and preventing flow from the second chamber to the return duct; and said first and second dampers are interconnected to move in unison between the open and closed positions thereof.

17. The invention of claim 16, including a linkage interconnecting said first and second dampers for movement in unison between the open and closed positions thereof, said adjusting means comprising power operated means for effecting movement of said dampers between the open and closed positions thereof when there is a discrepancy between the actual temperature conditions in the room and said preselected temperature conditions.

18. The invention of claim 15, including a third chamber presented in said terminal unit, said third chamber being isolated from said first and second chambers and having an outlet in the room for directing air from the third chamber into the room, said delivery duct means comprising a delivery duct receiving air at said constant volume rate and leading to said third chamber to supply said constant volume rate of air thereto for discharge into the patient room.

* * * * *